US009172157B2

(12) United States Patent
Burris

(10) Patent No.: US 9,172,157 B2
(45) Date of Patent: Oct. 27, 2015

(54) POST-LESS COAXIAL CABLE CONNECTOR WITH FORMABLE OUTER CONDUCTOR

(71) Applicant: CORNING OPTICAL COMMUNICATIONS RF LLC, Glendale, AZ (US)

(72) Inventor: Donald Andrew Burris, Peoria, AZ (US)

(73) Assignee: Corning Optical Communications RF LLC, Glendale, AZ (US)

( * ) Notice: Subject to any disclaimer, the term of this patent is extended or adjusted under 35 U.S.C. 154(b) by 0 days.

(21) Appl. No.: 14/451,917

(22) Filed: Aug. 5, 2014

(65) Prior Publication Data

US 2015/0044905 A1 Feb. 12, 2015

Related U.S. Application Data

(60) Provisional application No. 61/864,181, filed on Aug. 9, 2013.

(51) Int. Cl.

| | |
|---|---|
| ***H01R 9/05*** | (2006.01) |
| ***H01R 13/631*** | (2006.01) |
| ***H01R 24/40*** | (2011.01) |
| ***H01R 43/04*** | (2006.01) |
| *H01R 103/00* | (2006.01) |

(52) U.S. Cl.

CPC ..... *H01R 9/0524* (2013.01); *H01R 9/0518* (2013.01); *H01R 13/631* (2013.01); *H01R 24/40* (2013.01); *H01R 43/04* (2013.01); *H01R 2103/00* (2013.01)

(58) Field of Classification Search

CPC ..... H01R 9/0524; H01R 9/0518

USPC ..... 439/578, 584, 585

See application file for complete search history.

(56) References Cited

U.S. PATENT DOCUMENTS

| | | | | |
|---|---|---|---|---|
| 6,089,912 | A | 7/2000 | Tallis et al. | 439/584 |
| 6,089,913 | A * | 7/2000 | Holliday | 439/584 |
| 6,884,113 | B1 * | 4/2005 | Montena | 439/578 |
| 7,112,093 | B1 | 9/2006 | Holland | 439/585 |
| 7,189,115 | B1 * | 3/2007 | Montena | 439/584 |
| 7,264,502 | B2 | 9/2007 | Holland | 439/578 |
| 7,297,023 | B2 * | 11/2007 | Chawgo | 439/578 |
| 7,347,729 | B2 | 3/2008 | Thomas et al. | 439/583 |
| 7,351,101 | B1 * | 4/2008 | Montena | 439/584 |
| 7,371,113 | B2 | 5/2008 | Burris et al. | 439/578 |
| 7,507,116 | B2 | 3/2009 | Laerke et al. | 439/584 |

(Continued)

OTHER PUBLICATIONS

Patent Cooperation Treaty, International Search Report for PCT/US2014/049529, Dec. 17, 2014, 3 pages.

(Continued)

*Primary Examiner* — Ross Gushi

(57) ABSTRACT

A post-less coaxial cable connector comprising coupler, a formable outer conductor, body, and actuating insert. The coupler is adapted to attach the coaxial cable connector to a terminal. The outer conductor positions in and rotatably retains the coupler. Body attaches to the outer conductor and positions about the coupler. Actuating insert is movably positionable within the body and is configured to advance toward the coupler and urge the outer conductor of the coaxial cable connector radially inwardly to form the outer conductor about outer conductor of coaxial cable. In this manner, the coaxial cable connector is configured to attach to a coaxial cable other than by using a post.

16 Claims, 9 Drawing Sheets

(56) References Cited

U.S. PATENT DOCUMENTS

| | | | | |
|---|---|---|---|---|
| 7,544,094 | B1 * | 6/2009 | Paglia et al. | 439/585 |
| 7,566,236 | B2 * | 7/2009 | Malloy et al. | 439/321 |
| 7,588,460 | B2 * | 9/2009 | Malloy et al. | 439/578 |
| 7,645,161 | B2 * | 1/2010 | Holliday | 439/578 |
| 7,914,326 | B2 * | 3/2011 | Sutter | 439/584 |
| 8,062,063 | B2 * | 11/2011 | Malloy et al. | 439/578 |
| 8,109,786 | B2 * | 2/2012 | Lee et al. | 439/578 |
| 8,113,875 | B2 * | 2/2012 | Malloy et al. | 439/578 |
| 8,272,893 | B2 * | 9/2012 | Burris et al. | 439/578 |
| 8,323,056 | B2 * | 12/2012 | Clausen | 439/584 |
| 8,517,764 | B2 * | 8/2013 | Wei et al. | 439/578 |
| 8,591,244 | B2 * | 11/2013 | Thomas et al. | 439/321 |
| 8,657,624 | B2 * | 2/2014 | Yoshida | 439/578 |
| 8,721,365 | B2 * | 5/2014 | Holland | 439/584 |
| 2004/0031144 | A1 | 2/2004 | Holland | 29/825 |
| 2004/0259416 | A1 * | 12/2004 | Kodama et al. | 439/578 |
| 2006/0105628 | A1 | 5/2006 | Montena | 439/578 |
| 2007/0155232 | A1 | 7/2007 | Burris et al. | 439/578 |
| 2009/0014212 | A1 * | 1/2009 | Malak | 174/75 C |
| 2011/0003507 | A1 * | 1/2011 | Van Swearingen et al. | 439/578 |
| 2011/0117774 | A1 * | 5/2011 | Malloy et al. | 439/578 |
| 2011/0143586 | A1 | 6/2011 | Ehret et al. | 439/584 |
| 2013/0137300 | A1 * | 5/2013 | Eriksen et al. | 439/583 |
| 2013/0178096 | A1 * | 7/2013 | Matzen | 439/578 |
| 2013/0244484 | A1 * | 9/2013 | Wild et al. | 439/578 |
| 2014/0106614 | A1 * | 4/2014 | Burris et al. | 439/578 |
| 2014/0322968 | A1 * | 10/2014 | Burris | 439/578 |
| 2014/0342605 | A1 * | 11/2014 | Burris et al. | 439/578 |
| 2015/0044905 | A1 * | 2/2015 | Burris | 439/578 |

OTHER PUBLICATIONS

Patent Cooperation Treaty, Written Opinion of the International Searching Authority for PCT/US2014/049529, Dec. 17, 2014, 11 pages.

* cited by examiner

POST-LESS COAXIAL CABLE CONNECTOR WITH FORMABLE OUTER CONDUCTOR

RELATED APPLICATIONS

This application claims the benefit of priority under 35 U.S.C. §119 of U.S. Provisional Application No. 61/864,181 filed on Aug. 9, 2013, the content of which is relied upon and incorporated herein by reference in its entirety.

BACKGROUND

1. Field of the Disclosure

The disclosure relates generally to coaxial cable connectors, and particularly to coaxial cable connector configured to attach to a coaxial cable other than by the use of a post.

2. Technical Background

Coaxial cable connectors such as F-connectors are used to attach coaxial cables to another object such as an appliance or junction having a terminal adapted to engage the connector. Coaxial cable F-connectors are often used to terminate a drop cable in a cable television system. The coaxial cable typically includes a center conductor surrounded by a dielectric, which is in turn surrounded by a conductive grounding sheath in the form of one or both of a foil or braid, which acts as the outer conductor of the cable. The conductive grounding sheath is surrounded by a protective outer jacket. The F-connector is typically secured over the prepared end of the coaxial cable, allowing the end of the coaxial cable to be connected with a terminal block, such as by a threaded connection with a threaded terminal of a terminal block.

One type of F-connector crimp style having a crimp sleeve included as part of the connector body. A special radial crimping tool, having jaws that form a hexagon, is used to radially crimp the crimp sleeve around the outer jacket of the coaxial cable to secure the crimp style F-connector over the prepared end of the coaxial cable.

Another type of F-connector has a separate annular compression sleeve used to secure the F-connector over the prepared end of the cable. Rather than crimping a crimp sleeve radially toward the jacket of the coaxial cable, these F-connectors employ a plastic annular compression sleeve that is initially attached to the F-connector, but which is detached from the connector prior to installation of the F-connector. The compression sleeve includes an inner bore for allowing the compression sleeve to be passed over the end of the coaxial cable prior to installation of the F-connector. The end of the coaxial cable must be prepared by removing a portion of the outer braid and folding the outer braid back over the cable jacket. The F-connector itself is then placed over the prepared end of the coaxial cable such that the cable inserts into the connector. As the cable inserts into the connector, a hollow tubular post in the connector inserts under the cable braid and cable jacket. Next, the compression sleeve is compressed axially along the longitudinal axis of the connector into the body of the connector, simultaneously compressing the jacket of the coaxial cable between the compression sleeve and the tubular post of the connector. A number of commercial tool manufacturers provide compression tools for axially compressing the compression sleeve into such connectors.

Collars or sleeves within a coaxial cable connector can be compressed inwardly against the outer surface of a coaxial cable to secure a coaxial cable connector thereto. These connectors have a body portion that threadedly engages a nut portion. The nut portion includes an internal bore in which a ferrule is disposed, the ferrule having an internal bore through which the outer conductor of a coaxial cable is passed. As the nut portion is threaded over the body portion, the ferrule is wedged inwardly to constrict the inner diameter of the ferrule, thereby tightening the ferrule about the outer surface of the cable. However, this type of connector cannot be installed quickly as by a simple crimp or compression tool. Rather, the mating threads of such connector must be tightened, for example, by using a pair of wrenches. Additionally, the end of the coaxial cable must be prepared by stripping back the outer jacket to expose the conductive grounding sheath and center conductor. Then the conducting grounding sheath must be folded back, or everted, all of which takes time, tools, and patience.

SUMMARY OF THE DETAILED DESCRIPTION

Embodiments disclosed herein include a coaxial cable connector for coupling an end of a coaxial cable to a terminal. The coaxial cable connector has a coupler, a formable outer conductor, body, and actuating insert. The outer conductor positions in and rotatably retains the coupler. Body attaches to the outer conductor and positions about the coupler. Actuating insert is movably positionable within the body and is configured to advance toward the coupler and urge the outer conductor of the coaxial cable connector radially inwardly to form the outer conductor about outer conductor of coaxial cable. In this manner, the coaxial cable connector is configured to attach to a coaxial cable other than by using a post.

In another aspect, embodiments also disclosed herein include a coaxial cable connector for coupling an end of a coaxial cable to a terminal. The coaxial cable connector has a formable outer conductor having a plurality of slots, a raised portion, a cavity, and inwardly facing annular segments, with the annular segments having internal surfaces. A coupler is rotatably retained by the outer conductor. A body is attached to the outer conductor and positioned about the coupler. An actuating insert is movably positionable within the body and configured to advance toward the coupler and urge the outer conductor radially inwardly for forming the outer conductor about an outer conductor of a coaxial cable inserted in the coaxial cable connector.

In yet another aspect, embodiments also disclosed herein include a coaxial cable connector for coupling an end of a coaxial cable to a terminal. The coaxial cable connector has a formable outer conductor having a plurality of ribs, a raised portion, and an inwardly facing annular portion. A coupler is rotatably retained by the outer conductor. A body attached to the outer conductor and positioned about the coupler. An actuating insert movably positionable within the body and configured to advance toward the coupler and urge the outer conductor radially inwardly for forming the outer conductor about an outer conductor of a coaxial cable inserted in the coaxial cable connector.

Additional features and advantages are set out in the detailed description which follows, and in part will be readily apparent to those skilled in the art from that description or recognized by practicing the embodiments as described herein, including the detailed description, the claims, as well as the appended drawings.

It is to be understood that both the foregoing general description and the following detailed description are merely exemplary, and are intended to provide an overview or framework to understanding the nature and character of the claims. The accompanying drawings are included to provide a further understanding, and are incorporated in and constitute a part of this specification. The drawings illustrate one or more embodiment(s), and together with the description serve to explain principles and operation of the various embodiments.

DETAILED DESCRIPTION

Reference will now be made in detail to the embodiments, examples of which are illustrated in the accompanying drawings, in which some, but not all embodiments are shown. Indeed, the concepts may be embodied in many different forms and should not be construed as limiting herein. Whenever possible, like reference numbers will be used to refer to like components or parts.

Figure 1:
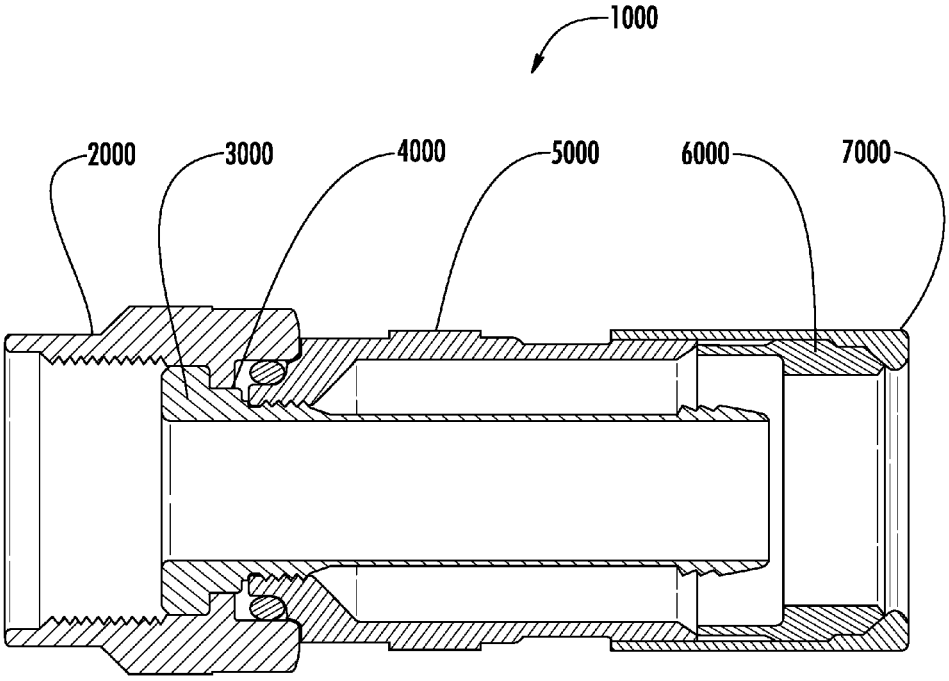
FIG. 1 is a partial cross-sectional view of a coaxial cable connector.

Referring to FIG. 1, a coaxial cable 1000 is illustrated comprising coupler 2000, post 3000, continuity member 4000, body 5000, gripping member 6000, and shell 7000. A coaxial cable (not shown in FIG. 1) may be inserted into the coaxial cable connector at the end with shell 7000. The coaxial cable connector 1000 may then be attached to a terminal or appliance equipment port (not shown in FIG. 1) to establish a mechanical and electrical connection between the coaxial cable and the terminal or appliance equipment port through the coaxial cable connector 1000. Prior to inserting the coaxial cable into the coaxial cable connector 1000, the end of the coaxial cable is prepared to assure that the coaxial cable makes the proper electrical and mechanical connection with the coaxial cable connector 1000. It should be understood that the terms "terminal" or "appliance port" are intended to mean any device to which the coaxial cable connector may connect and for the purposes of this disclosure the term "terminal" will be used to refer to any such device.

Figure 2:
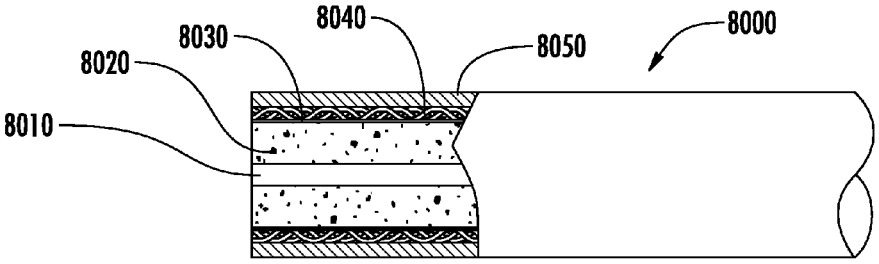
FIG. 2 is a partial cross-sectional view of a coaxial cable illustrating its structure including center conductor, dielectric layer, outer conductor and jacket.
Figure 2A:
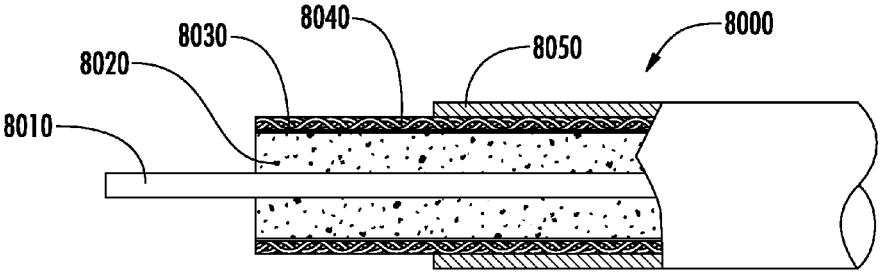
FIG. 2A is a partial cross-sectional view of the coaxial cable of FIG. 2 with the end partially prepared showing the jacket trimmed back and the center conductor exposed past the dielectric layer and the outer conductor.
Figure 2B:
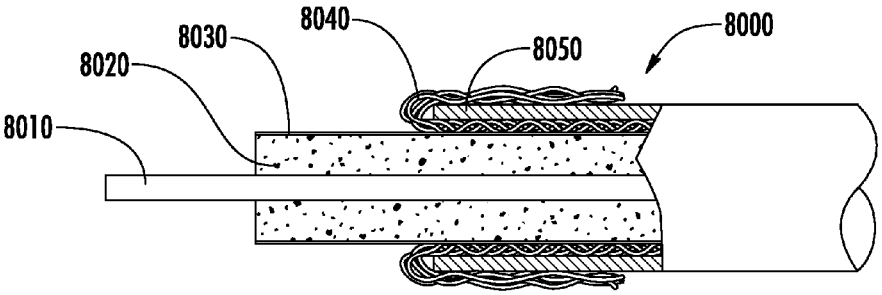
FIG. 2B is a partial cross-sectional view of the prepared coaxial cable of FIG. 2A showing the outer conductor folded back over the jacket.

FIGS. 2, 2A and 2B illustrate a coaxial cable 8000 and the manner in which the end of the coaxial cable 8000 may be prepared for use with coaxial cable connectors. Referring to FIG. 2, the coaxial cable 8000 has a center conductor 8010 that is surrounded by a dielectric layer 8020. Dielectric layer (or dielectric) 8020 may also have a foil or other metallic covering 8030. Coaxial cable 8000 has an outer conductor 8040 in the form of a braid which is covered and protected by a jacket 8050. Typically, to prepare the coaxial cable 8000 for attachment to a coaxial cable connector, a portion of the center conductor 8010 is exposed as illustrated in FIG. 2A. The jacket 8050 is trimmed back so that a portion of the dielectric 8020, metallic covering 8030, if present, and outer conductor 8040 are exposed. The outer conductor 8040 is then folded back over the jacket 8050 to expose the dielectric 8020 and the metallic covering 8030 as shown in FIG. 2B.

Figure 2C:
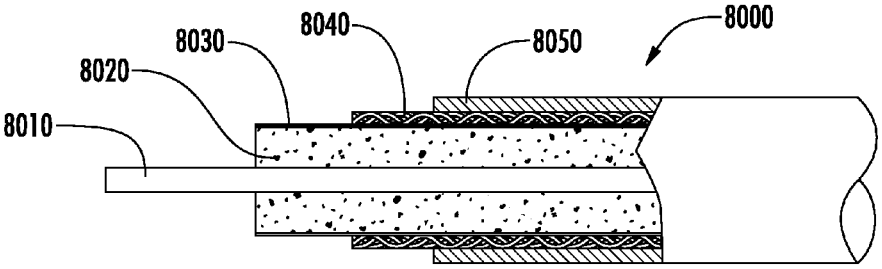
FIG. 2C is a partial cross-sectional view of the coaxial cable of FIG. 2A showing the outer conductor trimmed back but not folded back over the jacket as shown in FIG. 2B.

FIG. 2C illustrates coaxial cable 8000 with an end prepared differently than as shown in FIG. 2B. In FIG. 2C a portion of the center conductor 8010 is exposed and jacket 8050 and outer conductor 8040 are trimmed back so that a portion of the dielectric 8020 and metallic covering 8030 is exposed in a similar manner to the coaxial cable shown in FIG. 2B. However, in FIG. 2C a portion of outer conductor 8040 that is exposed is not folded back over the jacket 8050. Instead, outer conductor 8040 remains in place around dielectric 8020 and metallic covering 8030.

Figure 3:
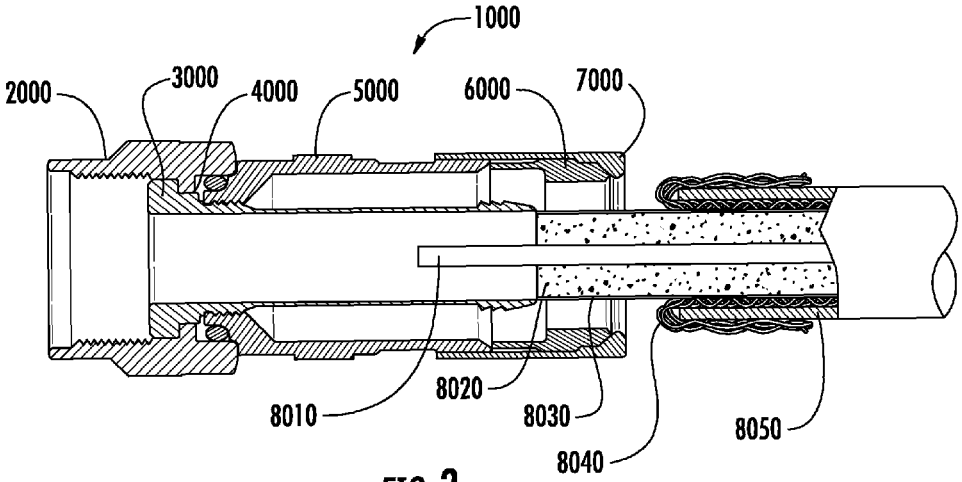
FIG. 3 is a partial cross-sectional view of the coaxial cable connector of FIG. 1 with the coaxial cable of FIG. 2B partially installed.

FIG. 3 illustrates the prepared coaxial cable 8000 of FIG. 2B partially inserted into coaxial connector 1000. The coaxial cable 8000 is shown extending into and through shell 7000 and gripping member 6000 to end of post 3000 such that dielectric 8020 and metallic covering 8030 is beginning to inserted into post 3000. Inserting dielectric 8020 and metallic covering 8030 into post 3000 such that post 3000 secures coaxial cable 8000 relative to coaxial connector 1000. However, post 3000 can cause problems for the coaxial connector 1000 as well as the installer. As discussed previously, coaxial cable 8000 must be prepared such that dielectric 8020 and metallic covering 8030 can be aligned with and inserted into post 3000. Post 3000 can skive dielectric 8020 and metallic covering 8030, or tear outer conductor 8040 or jacket 8050. Additionally, it can be difficult to insert dielectric 8020 and metallic covering 8030 into post 3000 due to diametrical tolerances of both post 3000 and coaxial cable 8000. Further, manufacturing burrs or other damage may be present on the coaxial cable insertion end of post 3000 causing further difficulty inserting dielectric 8020 and metallic covering 8030 into post 3000.

Figure 4:
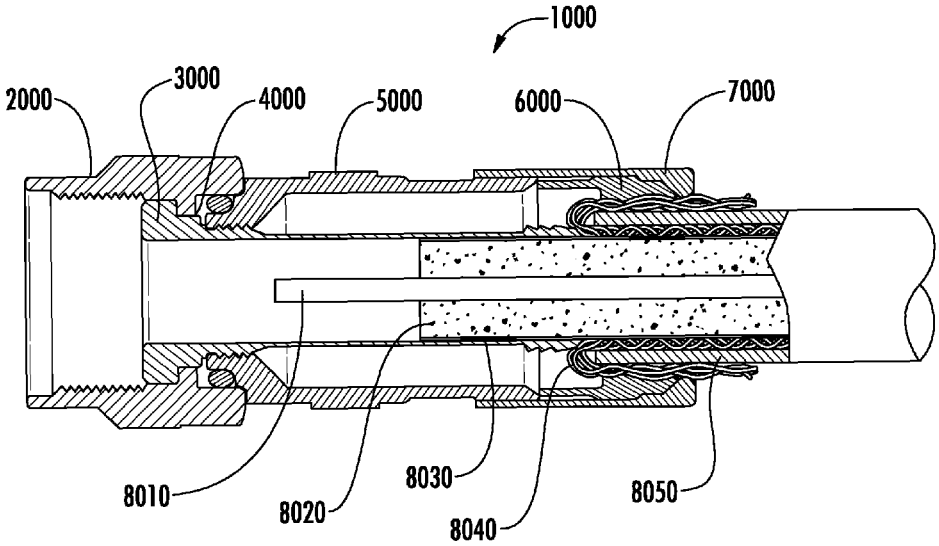
FIG. 4 is a partial cross-sectional view of the coaxial cable connector of FIG. 1 with the coaxial cable of FIG. 2B further partially installed than as shown in FIG. 3.

FIG. 4 illustrates the prepared coaxial cable of FIG. 2B further partially inserted into coaxial connector 1000. As shown in FIG. 4, outer conductor 8040 and jacket 8050 must pass over post 3000 and through gripping member 6000 as the coaxial cable 8000 is further inserted into coaxial connector 1000. With outer conductor 8040 folded back over jacket 8050 the outermost dimension of the prepared cable can become relatively large compared to the passageway provided in gripping member 6000. Additionally, if jacket 8050 is thicker than allowed specification, the outermost dimension of the prepared cable can become relatively even larger compared to the passageway provided in gripping member 6000. All this can make it difficult, if not impossible to insert cable 8000 into coaxial connector 1000.

Figure 5:
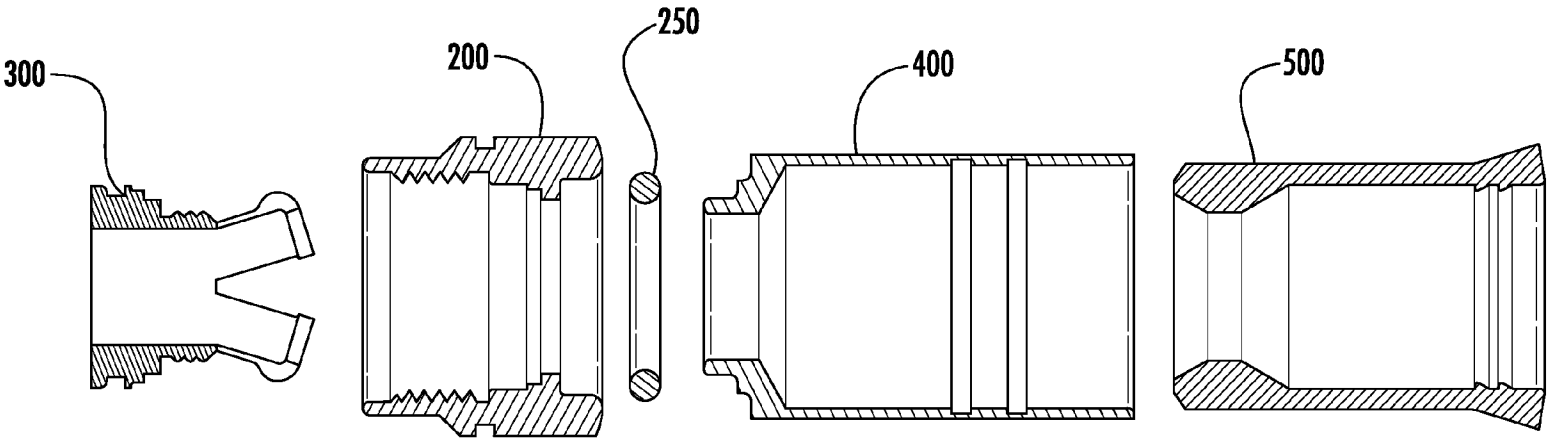
FIG. 5 is an exploded, cross-sectional view of an exemplary embodiment of a coaxial cable connector.

An exploded, cross-sectional view of an exemplary embodiment of a coaxial cable connector 100 is illustrated in FIG. 5. Coaxial cable connector 100 has a coupler 200, outer conductor 300, body 400, actuating insert 500, and an optional O-ring 250. The coupler 200 is adapted to attach the coaxial cable connector to a terminal (not shown in FIG. 5). Although, outer conductor 300 is shown in FIG. 5 as being tubular, outer conductor 300 may be any appropriate shape. Outer conductor 300 is formable and positions in and rotatably retains the coupler 200. Outer conductor 300 is configured to close about outer conductor 8040 of coaxial cable 8000. Body 400 attaches to outer conductor 300. Actuating insert 500 is movably positionable within body 300 and configured to advance toward the coupler 200 and urge the outer conductor 300 of the coaxial cable connector 100 radially inwardly to close outer conductor 300 about outer conductor 8040 of coaxial cable 8000. It should be noted that coaxial cable connector 100 does not have a post that engages the coaxial cable between the dielectric and the outer conductor as illustrated in FIG. 3. As such, coaxial cable connector 100 is configured to attach to a coaxial cable other than by using a post.

Figure 7:
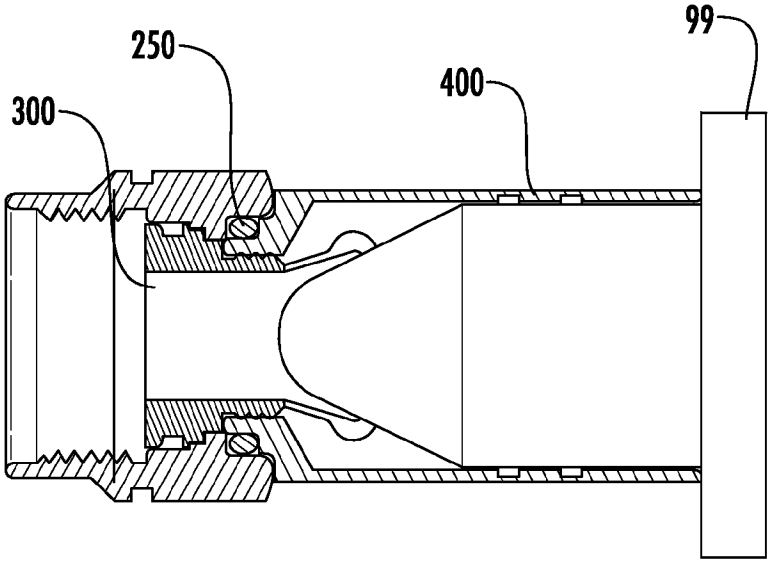
FIG. 7 is a partial cross-sectional view of the coaxial cable connector of FIG. 5 in a state of partial assembly with the tubular outer conductor flared with an assembly tool.
Figure 6:
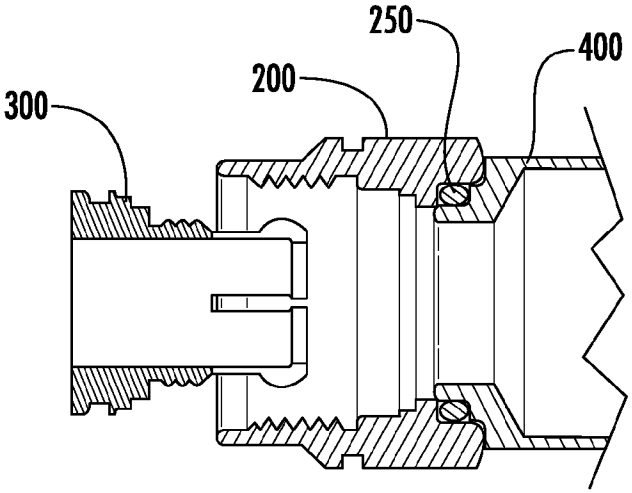
FIG. 6 is a partial cross-sectional view of the coaxial cable connector of FIG. 5 in a state of partial assembly.

FIGS. 6 and 7 describe the factory level assembly of some of the components of coaxial cable connector 100 of FIG. 5. O-ring 250 and coupler 200 are positioned about body 400 and outer conductor 300 is introduced at front end 220 of coupling 200. In FIG. 5, outer conductor 300 is shown as having flared annular segments 320. However, in an unassembled state outer conductor 300 is in an as-machined or un-flared condition allowing it to pass through and into body 400. To flare the annular segments 320, an assembly tool is used. In FIG. 7 assembly tool 99 inserts into coaxial cable connector 100 and forces annular segments 320 to flare radially outwardly in a tapered condition. The flared annular segments 320 will be discussed in more detail herein.

Figure 8:
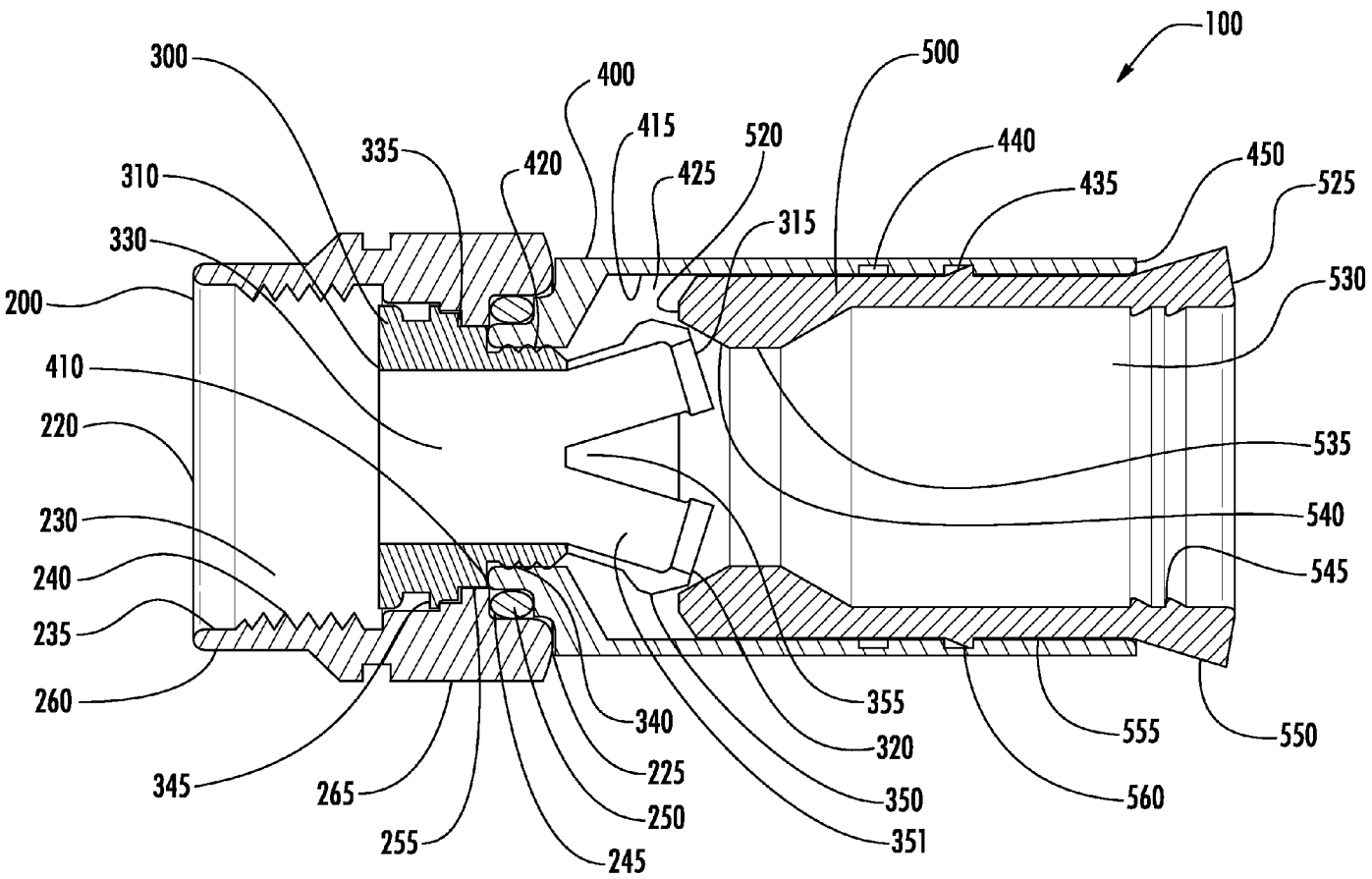
FIG. 8 is a cross-sectional view of the coaxial cable connector of FIG. 5 in the assembled state.

FIG. 8 illustrates coaxial cable connector 100 in an assembled state. Coupler 200 has a front end 220, a back end 225, and an opening 230 extending therebetween. Opening 230 of coupler 200 has an internal surface 235, which includes threaded portion 240 and a channel 245. Channel 245 is configured to receive an elastic O-ring 250 to seal coaxial cable connector 100. Coupler 200 also has an inwardly projecting ring 255 to engage rearward facing shoulder 335 of outer conductor 300. Coupler 200 also has a smooth outer surface 260 adjacent front end 220 and a hexagonal configuration portion 265 adjacent back end 225. Coupler 200 may be made from any suitable material, including, as a non-limiting example, a metallic material, such as brass, and may be plated with a conductive, corrosion-resistant material, such as nickel.

Outer conductor 300 has a front end 310 and a back end 315. Extending therebetween is internal surface 330. Rearward facing annular surface 335 serves to rotatably retain coupler 200. Outer surface 340 engages and attaches to body 400 by means of a press fit and may have optional monolithic grounding flange 345. Outer conductor 300 is further comprised of a plurality of slots 355, raised portion 350, cavity 351 and inwardly facing annular segments 320. Outer conductor 300 may be made from any suitable material, including, as a non-limiting example, a metallic material, such as brass, and may be plated with a conductive, corrosion-resistant material, such as tin.

Body 400 has an internal surface 415 extending between front end 410 and rear end 450 and defining longitudinal opening 425. Additionally, body 400 has inner surface 420, which engages outer conductor 300, first internal annular grooves 435 and second internal annular 440 to retain the actuating insert 500. Body 400 may be made of any suitable material, as non-limiting examples, plastic such as acetal, or brass, and may be plated with a conductive, corrosion-resistant material, such as nickel.

Actuating insert 500 has a front end 520, a back end 525, and an opening 530 extending there between. Opening 530 of actuating insert 500 has an internal surface 535 and ramped surface 540 proximate front end 520. Internal surface 535 also includes barbed portion 545. Actuating insert 500 is further comprised of external surface 555. External surface 555 has a detent 560, which may be in the form of a protrusion, and tapered portion 550 proximate back end 525. Actuating insert 500 may be made from any suitable material, as a non-limiting example, plastic.

Figure 9:
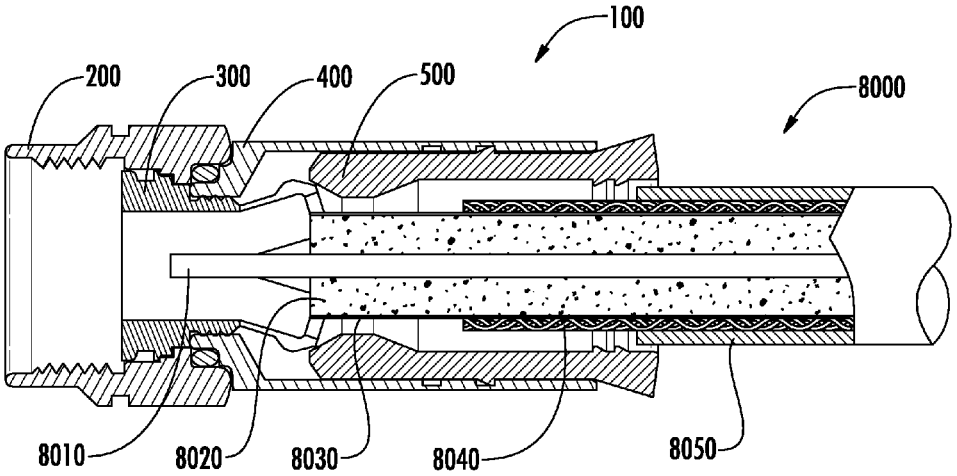
FIG. 9 is a partial cross-sectional of the coaxial cable connector of FIG. 8 in an un-compressed or open condition with the prepared coaxial cable of FIG. 2C partially inserted therein.
Figure 10:
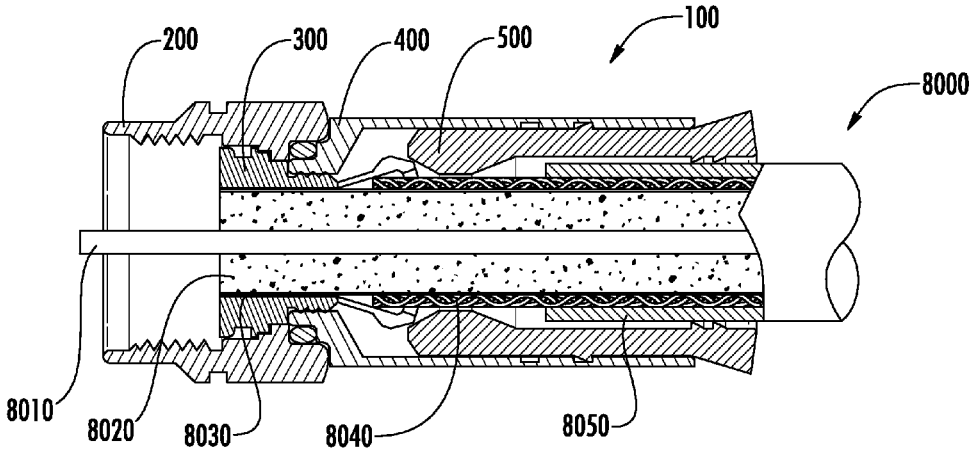
FIG. 10 is a partial cross-sectional view of the coaxial cable connector of FIG. 8 in an un-compressed or open condition with the prepared coaxial cable of FIG. 2C fully inserted therein.
Figure 11:
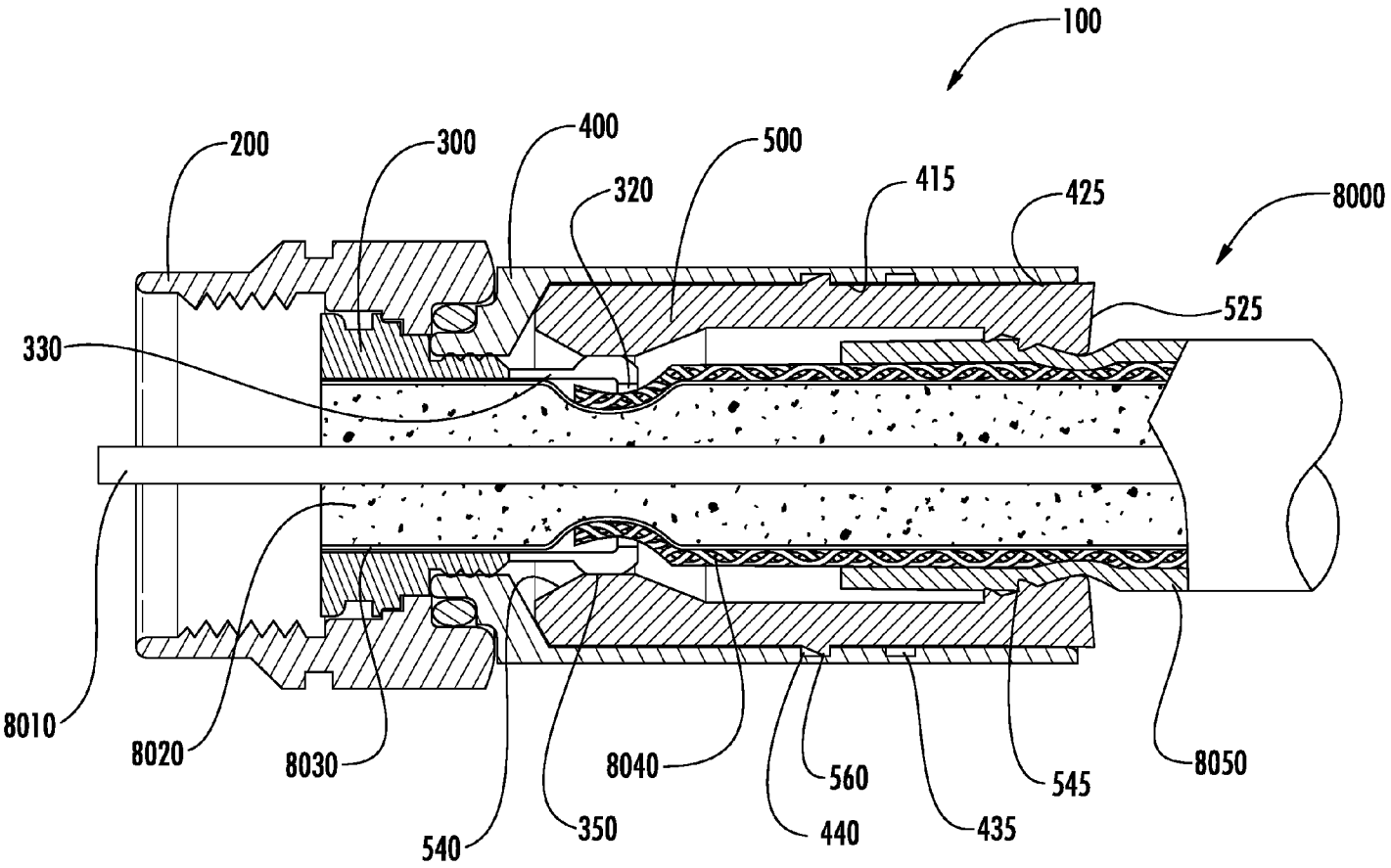
FIG. 11 is a partial cross-sectional view of the coaxial cable connector of FIG. 8 and prepared coaxial cable of FIG. 2C with the coaxial connector in a closed state.

Referring now to FIGS. 9, 10 and 11, the engagement of coaxial cable connector 100 with coaxial cable 8000 will be discussed. As shown in FIG. 6, coaxial cable 8000 of FIG. 2C is inserted through opening 530 of actuating insert 500 and into cavity 351 of outer conductor 300. Suitable clearance between the cable 8000 and the connector components is provided allowing the coaxial cable 8000 to enter the coaxial cable connector 100 with ease.

Turning to FIG. 10 cable 8000 is further advanced bringing cable dielectric 8020 flush with front end 310 of outer conductor 300. Outer conductor 8040 is positioned within cavity 351 of outer conductor 300 and cable jacket 8050 is positioned within opening 530 of actuating insert 500.

FIG. 11 illustrates coaxial cable connector 100 in a closed or compressed condition. Advancing actuator insert 500 forward in the direction of coupler 200 causes ramped portion 540 of actuator insert 500 to be driven over raised portion 350 of outer conductor 300. In this manner, actuator insert 500 urges at least a portion of internal surface 330 radially inwardly, forming outer conductor and closing internal surfaces 330 about outer conductor 8040 causing internal surfaces of annular segments 320 to contact outer conductor 8040 providing both mechanical retention and electrical contact between annular segments 320 and outer conductor 8040. Backend 525 of actuating insert is forced radially inwardly by the contours of 415 internal surface of body 400 causing barbed portion 545 to engage jacket 8050 and creating a 360 degree seal between actuating insert 500, body 400 and cable jacket 8050 proximate backend 525. Detent 560 has an initial or first position and a final or second position. When the actuating insert 500 advances toward the coupler 200, detent 560 moves from its first position within first internal annular groove 440 to second position within second internal annual groove 435 providing axial retention of actuating insert 500 with in body 400.

Figure 12:
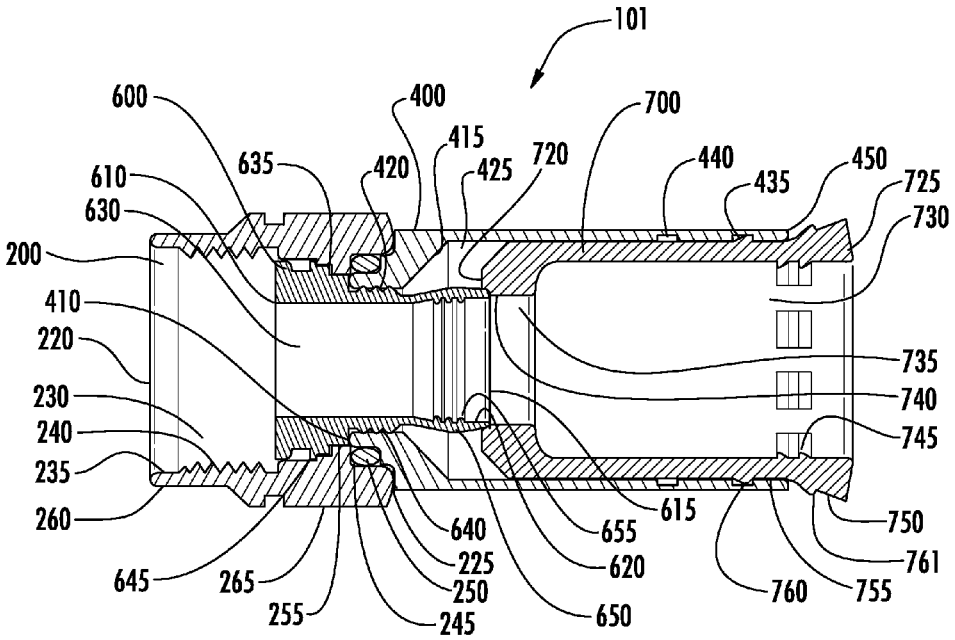
FIG. 12 is a cross-sectional view of an exemplary embodiment of a coaxial cable connector as disclosed herein in an open state.

FIG. 12 illustrates an exemplary embodiment of coaxial cable connector 101. Wherever possible, the same numbers for the same components as used for coaxial cable connector 100, and will be used to describe coaxial cable connector 101. Additionally, components with the same or same or similar function as in coaxial cable connector 100 may not be described again with respect to coaxial cable connector 101. Coaxial cable connector 101 has a coupler 200, outer conductor 600, body 400, actuating insert 700, and an optional O-ring 250. The coupler 200 is adapted to attach the coaxial cable connector to a terminal (not shown in FIG. 12). Although, outer conductor 600 is shown in FIG. 12 as being tubular, outer conductor 600 may be any appropriate shape. Outer conductor 600 is formable and positions in and rotatably retains the coupler 200. The outer conductor 600 is configured to close about outer conductor 8040 of coaxial cable 8000. Body 400 attaches to the outer conductor 600. Actuating insert 700 is movably positionable within the body 300 and configured to advance toward the coupler 200 and urge the outer conductor 600 of the coaxial cable connector 101 radially inwardly to close the outer conductor 600 about outer conductor 8040 of coaxial cable 8000 inserted in the coaxial cable connector 101. It should be noted that coaxial cable connector 101 does not have a post that engages the coaxial cable between the dielectric and the outer conductor as illustrated in FIG. 3. As such, the coaxial cable connector 100 is configured to attach to coaxial cable 8000 other than by using a post.

Outer conductor 600 has a front end 610 and a back end 615. Extending therebetween is internal surface 630. Rearward facing annular surface 635 serves to rotatably retain coupler 200. Outer surface 640 engages body 400 by means of a press fit. Outer conductor 600 may have optional monolithic grounding flange 645. Outer conductor 600 is further comprised of a plurality of ribs 655, raised portion 650, and inwardly facing annular portion 620. Outer conductor 600 is preferably made from a metallic material, such as brass, and it is plated with a conductive, corrosion-resistant material, such as tin, but it may be made from any appropriate material.

Actuating insert 700 has a front end 720, a back end 725, and an opening 730 extending therebetween. Opening 730 of actuating insert 700 has an internal surface 735 and ramped surface 740 proximate front end 720. Internal surface 735 also includes barbed portion 745. Actuating insert 700 is further comprised of external surface 755. External surface 755 has a detent 760, which may be in the form of a protrusion, and tapered portion 750 proximate back end 725. Actuating insert 700 is preferably also made from plastic, but may be made from any appropriate material.

Figure 13:
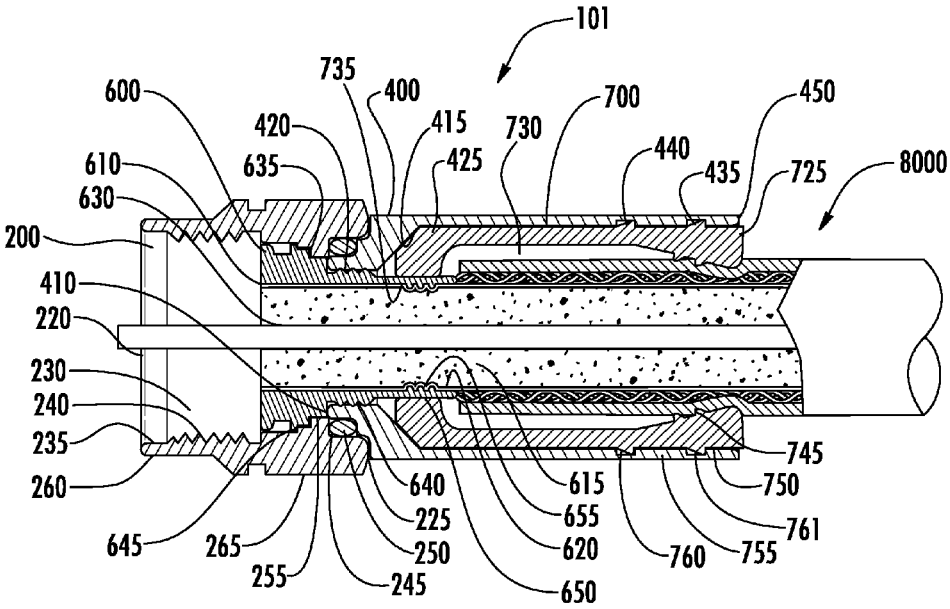
FIG. 13 is a cross-sectional view of the coaxial cable connector of FIG. 12 in a closed state.

FIG. 13 illustrates connector 101 in a closed or compressed condition with coaxial cable 8000 inserted therein. Advancing actuator insert 700 forward in the direction of coupler 200 causes ramped portion 740 of actuator insert 700 to be driven over raised portion 650 of outer conductor 600 urging at least a portion of internal surface 630 radially inwardly, forming at least a portion of internal surface 630 about outer conductor 8040 causing annular ribs 655 to contact outer conductor 8040 providing both mechanical retention and electrical contact between annular ribs 655 and outer conductor 8040. Backend 725 of actuating insert 700 is forced radially inwardly by the contours of 415 internal surface of body 400 causing barbed portion 745 to engage jacket 8050 and creating a 360 degree seal between actuating insert 700, body 400 and jacket 8050 proximate backend 725. Detent 760 has an initial or first position and a final or second position. When the actuating insert 700 advances toward the coupler 200, detent 760 moves from its first position within first internal annular groove 435 to second position within second internal annual groove 440 providing axial retention of actuating insert 700 with in body 400.

Many modifications and other embodiments set forth herein will come to mind to one skilled in the art to which the embodiments pertain having the benefit of the teachings presented in the foregoing descriptions and the associated drawings. Therefore, it is to be understood that the description and claims are not to be limited to the specific embodiments disclosed and that modifications and other embodiments are intended to be included within the scope of the appended claims.

It is intended that the embodiments cover the modifications and variations of the embodiments provided they come within the scope of the appended claims and their equivalents. Although specific terms are employed herein, they are used in a generic and descriptive sense only and not for purposes of limitation.

I claim:

1. A coaxial cable connector for coupling an end of a coaxial cable to a terminal, the coaxial cable connector comprising:

an outer conductor, wherein the outer conductor is formable;

a coupler rotatably retained by the outer conductor;

a body attached to the outer conductor and positioned about the coupler; and an actuating insert movably positionable within the body and configured to advance toward the coupler and urge the outer conductor radially inwardly for forming the outer conductor about an outer conductor of a coaxial cable inserted in the coaxial cable connector.

2. The coaxial cable connector of claim 1, further comprising an O-ring positioned about the body.

3. The coaxial cable connector of claim 1, wherein the outer conductor is tubular.

4. The coaxial cable connector of claim 1, wherein the body attached to the outer conductor by a press fit.

5. The coaxial cable connector of claim 1, wherein the actuating insert is configured to cause an internal surface of the outer conductor to contact the outer conductor of the coaxial cable when the actuating insert is advanced toward the coupler.

6. The coaxial cable connector of claim 1, wherein the actuating insert has a front end, a back end, and an opening extending therebetween.

7. The coaxial cable connector of claim 6, wherein the opening has an internal surface and a ramped surface proximate the front end.

8. The coaxial cable connector of claim 6, wherein the ramped surface is configured to urge the outer conductor radially inwardly.

9. The coaxial cable connector of claim 1, wherein the body has an internal surface having a first internal annular groove and second annular groove for retaining the actuating insert.

10. The coaxial cable connector of claim 9, wherein the actuating insert has a detent configured to move from a first position in the first annular groove in the body and to a second position in the second annual groove in the body when the actuating insert is advanced toward the coupler.

11. The coaxial cable connector of claim 1, wherein the actuating insert has a barbed portion configured to engage a jacket of a coaxial cable inserted in the coaxial cable connector to create a 360 degree seal between actuating insert, body and the jacket proximate backend when the actuating insert is advanced toward the coupler.

12. A coaxial cable connector for coupling an end of a coaxial cable to a terminal, the coaxial cable connector comprising:

an outer conductor, wherein the outer conductor is formable and wherein the outer conductor comprises, a plurality of slots, a raised portion, a cavity, and inwardly facing annular segments, wherein the annular segments have internal surfaces;

a coupler rotatably retained by the outer conductor;

a body attached to the outer conductor and positioned about the coupler; and an actuating insert movably positionable within the body and configured to advance toward the coupler and urge the outer conductor radially inwardly for forming the outer conductor about an outer conductor of a coaxial cable inserted in the coaxial cable connector.

13. The coaxial cable connector of claim 12, wherein the annular segments have a radially outward flare for receiving a coaxial cable.

14. The coaxial cable connector of claim 12, wherein the actuating insert is configured to cause the internal surfaces of the annular segments to contact the outer conductor of the coaxial cable inserted in the coaxial cable connector.

15. A coaxial cable connector for coupling an end of a coaxial cable to a terminal, the coaxial cable connector comprising:

an outer conductor, wherein the outer conductor is formable and wherein the outer conductor comprises, a plurality of ribs, a raised portion, and an inwardly facing annular portion;

a coupler rotatably retained by the outer conductor;

a body attached to the outer conductor and positioned about the coupler; and an actuating insert movably positionable within the body and configured to advance toward the coupler and urge the outer conductor radially inwardly for forming the outer conductor about an outer conductor of a coaxial cable inserted in the coaxial cable connector.

16. The coaxial cable connector of claim 15, wherein the actuating insert is configured to cause the annular ribs to contact outer conductor.

* * * * *